US005271884A

United States Patent [19]

Huang

[11] Patent Number: 5,271,884

[45] Date of Patent: Dec. 21, 1993

[54] MANGANESE AND TANTALUM-MODIFIED TITANIUM ALUMINA ALLOYS

[75] Inventor: Shyh-Chin Huang, Latham, N.Y.

[73] Assignee: General Electric Company, Schenectady, N.Y.

[21] Appl. No.: 404,479

[22] Filed: Sep. 8, 1989

[51] Int. Cl.[5] ..... C22C 14/00

[52] U.S. Cl. ..... 420/418; 420/421

[58] Field of Search ..... 420/418, 421

[56] References Cited

U.S. PATENT DOCUMENTS 4,661,316 4/1987 Hashimoto et al. ..... 420/418

4,842,817 6/1989 Huang et al. ..... 420/418

FOREIGN PATENT DOCUMENTS 621884 6/1961 Canada ..... 420/418

*Primary Examiner*—Donald P. Walsh

*Assistant Examiner*—Ngoclan T. Mai

*Attorney, Agent, or Firm*—Paul E. Rochford; James Magee, Jr.

[57] ABSTRACT

A TiAl composition is prepared to have high strength and to have improved ductility by altering the atomic ratio of the titanium and niobium to have what has been found to be a highly desirable effective aluminum concentration by addition of a combination of manganese and tantalum according to the approximate formula:

$Ti_{52-43}Al_{46-50}Ta_{1-4}Mn_{1-3}$.

7 Claims, 4 Drawing Sheets

MANGANESE AND TANTALUM-MODIFIED TITANIUM ALUMINA ALLOYS

CROSS REFERENCE TO RELATED APPLICATIONS

The subject application relates to copending applications as follows: Ser. Nos. 138,407, now U.S. Pat. No. 4,836,983, 138,408, 138,476, now U.S. Pat. No. 4,857,268, 138,481, 138,486, filed Dec. 28, 1987; Ser. No. 201,984 filed Jun. 3, 1988; Ser. No. 252,622, filed Oct. 3, 1988; Ser. No. 293,035, filed Jan. 3, 1989.

The texts of these related applications are incorporated herein by reference.

BACKGROUND OF THE INVENTION

The present invention relates generally to alloys of titanium and aluminum. More particularly, it relates to alloys of titanium and aluminum which have been modified both with respect to stoichiometric ratio and with respect to manganese and tantalum addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma.

The alloy of titanium and aluminum having a gamma crystal form, and a stoichiometric ratio of approximately one, is an intermetallic compound having a high modulus, a low density, a high thermal conductivity, good oxidation resistance, and good creep resistance. The relationship between the modulus and temperature for TiAl compounds to other alloys of titanium and in relation to nickel base superalloys is shown in FIG. 3. As is evident from the figure, the gamma TiAl has the best modulus of any of the titanium alloys. Not only is the gamma TiAl modulus higher at temperature but the rate of decrease of the modulus with temperature increase is lower for gamma TiAl than for the other titanium alloys. Moreover, the gamma TiAl retains a useful modulus at temperatures above those at which the other titanium alloys become useless. Alloys which are based on the gamma TiAl intermetallic compound are attractive lightweight materials for use where high modulus is required at high temperatures and where good environmental protection is also required.

One of the characteristics of gamma TiAl which limits its actual application to such uses is a brittleness which is found to occur at room temperature. Also, the strength of the intermetallic compound at room temperature needs improvement before the gamma TiAl intermetallic compound can be exploited in structural component applications. Improvements of the gamma TiAl intermetallic compound to enhance ductility and/or strength at room temperature are very highly desirable in order to permit use of the compositions at the higher temperatures for which they are suitable.

With potential benefits of use at light weight and at high temperatures, what is most desired in the gamma TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility and higher strengths are often preferred for some applications.

The stoichiometric ratio of gamma TiAl compounds can vary over a range without altering the crystal structure. The aluminum content can vary from about 50 to about 60 atom percent. However, the properties of gamma TiAl compositions are subject to very significant changes as a result of relatively small changes of one percent or more in the stoichiometric ratio of the titanium and aluminum ingredients. Also, the properties are similarly affected by the addition of relatively similar small amounts of ternary elements.

I have now discovered that further improvements can be made in the gamma TiAl intermetallic compounds by incorporating therein a combination of additive elements so that the composition not only contains a ternary additive element but also a quaternary additive element.

Furthermore, I have discovered that the composition including the quaternary additive element has a uniquely desirable combination of properties which include a desirably high ductility and a valuable oxidation resistance.

PRIOR ART

There is extensive literature on the compositions of titanium aluminum including the $Ti_3Al$ intermetallic compound, the TiAl intermetallic compounds and the $TiAl_3$ intermetallic compound. A U.S. Pat. No. 4,294,615, entitled "TITANIUM ALLOYS OF THE TiAl TYPE" contains an extensive discussion of the titanium aluminide type alloys including the TiAl intermetallic compound. As is pointed out in the patent in column 1, starting at line 50, in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

> "Those well skilled recognize that there is a substantial difference between the two ordered phases. Alloying and transformational behavior of $Ti_3Al$ resemble those of titanium, as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy.

A number of technical publications dealing with the titanium aluminum compounds as well as with the characteristics of these compounds are as follows:

1. E.S. Bumps, H.D. Kessler, and M. Hansen, "*Titanium-Aluminum System*", Journal of Metals, June 1952, pp. 609-614, TRANSACTIONS AIME, Vol. 194.
2. H.R. Ogden, D.J. Maykuth, W.L. Finlay, and R.I. Jaffee, "*Mechanical Properties of High Purity Ti-Al Alloys*", Journal of Metals, February 1953, pp. 267-272, TRANSACTIONS AIME, Vol. 197.

Four additional papers contain limited information about the mechanical behavior of TiAl base alloys modified by niobium. These two papers are as follows:

3. Joseph B. McAndrew, and H.D. Kessler, "*Ti-36 Pct Al as a Base for High Temperature Alloys*", Journal of Metals, October 1956, pp. 1348-1353, TRANSACTIONS AIME, Vol. 206.
4. S.M.L. Sastry, and H.A. Lipsitt, "*Plastic Deformation of TiAl and $Ti_3Al$*", Titanium 80 (Published by American Society for Metals, Warrendale, Pa), Vol. 2 (1980) page 1231.
5. Patrick L. Martin, Madan G. Mendiratta, and Harry A. Lispitt, "*Creep Deformation of TiAl and TiAl+W Alloys*", Metallurgical Transactions A, Volume 14A (October 1983) pp. 2171-2174.
6. P.L. Martin, H.A. Lispitt, N.T. Nuhfer, and J.C. Williams, "*The Effects of Alloying on the Microstructure and Properties of $Ti_3Al$ and TiAl*", Titanium 80, (Published by American Society for Metals, Warrendale, Pa.), Vol. 2, pp. 1245-1254.

U.S. Pat. No. 4,661,316 (Hashimoto) teaches titanium aluminide compositions which contain manganese as well as manganese plus other ingredients but not tantalum.

BRIEF DESCRIPTION OF THE INVENTION

One object of the present invention is to provide a method of forming a titanium aluminum intermetallic compound having improved ductility, and related properties at room temperature.

Another object is to improve the properties of titanium aluminum intermetallic compounds at low and intermediate temperatures.

Another object is to provide an alloy of titanium and aluminum having improved properties and processability at low and intermediate temperatures.

Another object is to improve the combination of ductility and oxidation resistance of TiAl base compositions.

Still another object is to improve the oxidation resistance of TiAl compositions.

Yet another object is to make improvements in a set of strength, ductility and oxidation resistance properties.

Other objects will be in part apparent, and in part pointed out in the description which follows.

In one of its broader aspects, the objects of the present invention are achieved by providing a nonstoichiometric TiAl base alloy, and adding a relatively low concentration of manganese and a low concentration of tantalum to the nonstoichiometric composition. The addition may be followed by rapidly solidifying the manganese- and tantalum-containing nonstoichiometric TiAl intermetallic compound. Addition of manganese in the order of approximately 1 to 3 atomic percent and of tantalum to the extent of 1 to 3 atomic percent is contemplated.

The rapidly solidified composition may be consolidated as by isostatic pressing and extrusion to form a solid composition of the present invention.

The alloy of this invention may also be produced in ingot form and may be processed by ingot metallurgy.

DETAILED DESCRIPTION OF THE INVENTION

Figure 1:
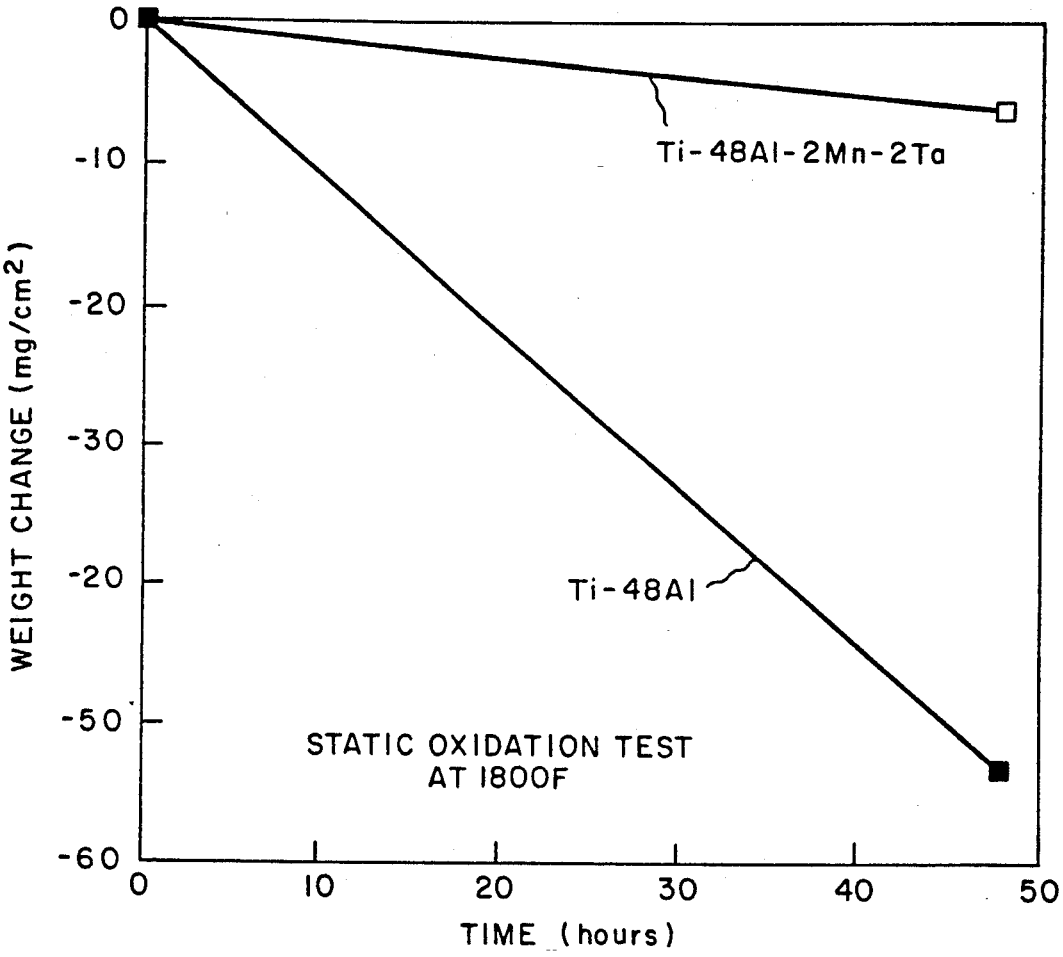
FIG. 1 is a graph displaying comparative oxidation resistance properties.
Figure 2:
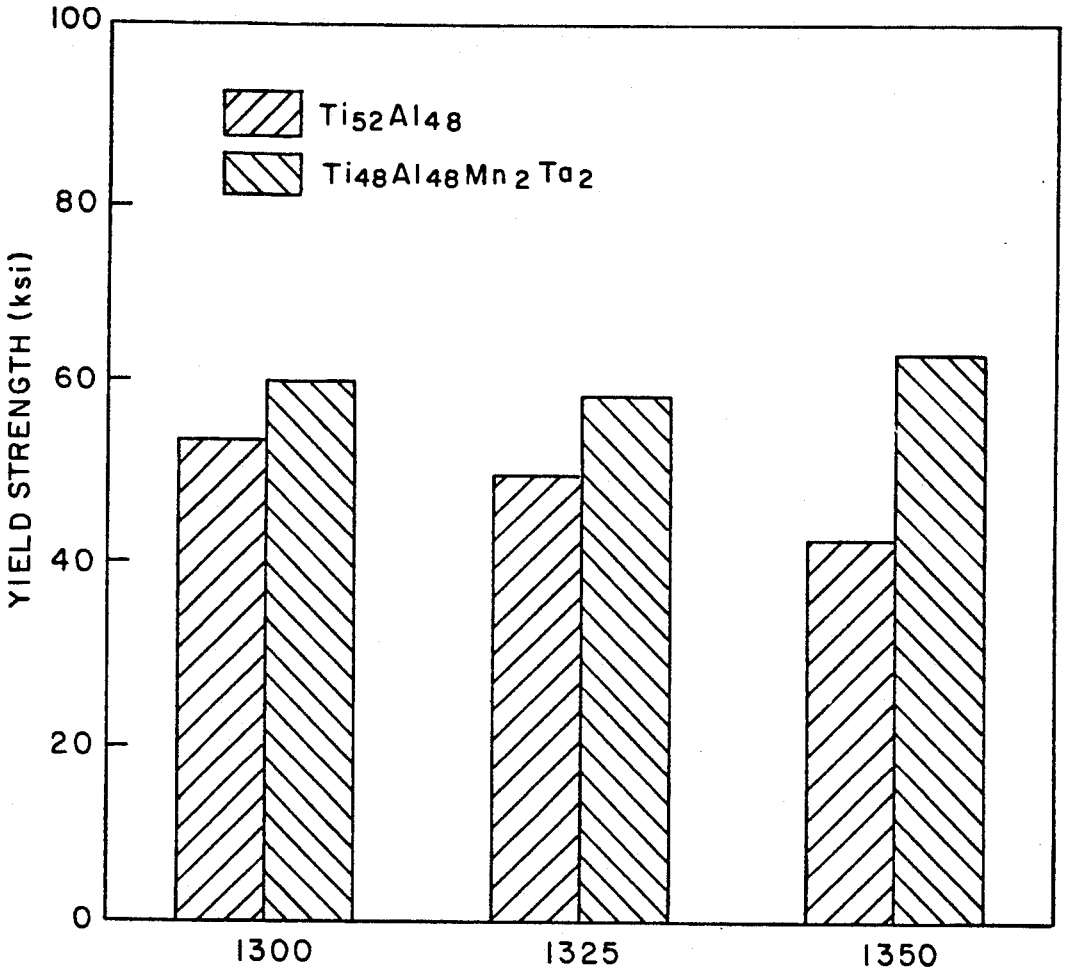
FIG. 2 is a bar graph displaying yield strength in ksi for samples given different heat treatments.
Figure 3:
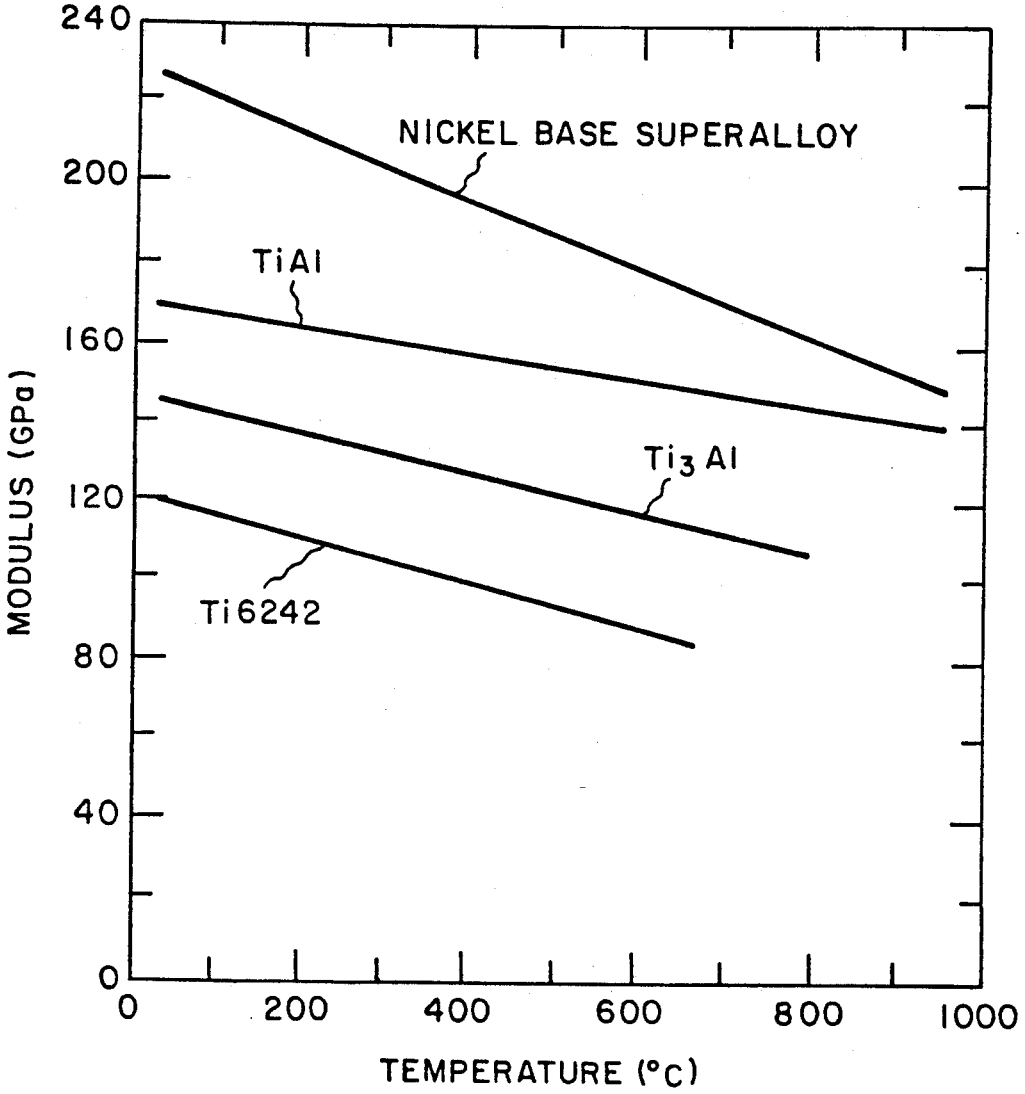
FIG. 3 is a graph illustrating the relationship between modulus and temperature for an assortment of alloys.

There are a series of background and current studies which led to the findings on which the present invention, involving the combined addition of manganese and tantalum to a gamma TiAl are based. The first twenty one examples deal with the background studies and the later examples deal with the current studies.

EXAMPLES 1∝3

Three individual melts were prepared to contain titanium and aluminum in various stoichiometric ratios approximating that of TiAl. The compositions, annealing temperatures and test results of tests made on the compositions are set forth in Table I.

For each example, the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also, care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and was extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of 1.5×3×25.4 mm (0.060×0.120×1.0 in.) for four point bending tests at room temperature. The bending tests were carried out in a 4-point bending fixture having an inner span of 10 mm (0.4 in.) and an outer span of 20 mm (0.8 in.). The load-crosshead displacement curves were recorded. Based on the curves developed, the following properties are defined:

(1) Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurements' results in many of the examples herein is between four point bending tests, and for all samples measured by this technique, such comparisons are quite valid in establishing the differences in strength properties resulting from differences in composition or in processing of the compositions.

(2) Fracture strength is the stress to fracture.

(3) Outer fiber strain is the quantity of 9.71 hd, where "h" is the specimen thickness in inches, and "d" is the cross head displacement of fracture in inches. Metallurgically, the value calculated represents the amount of plastic deformation experienced at the outer surface of the bending specimen at the time of fracture.

Figure 4:
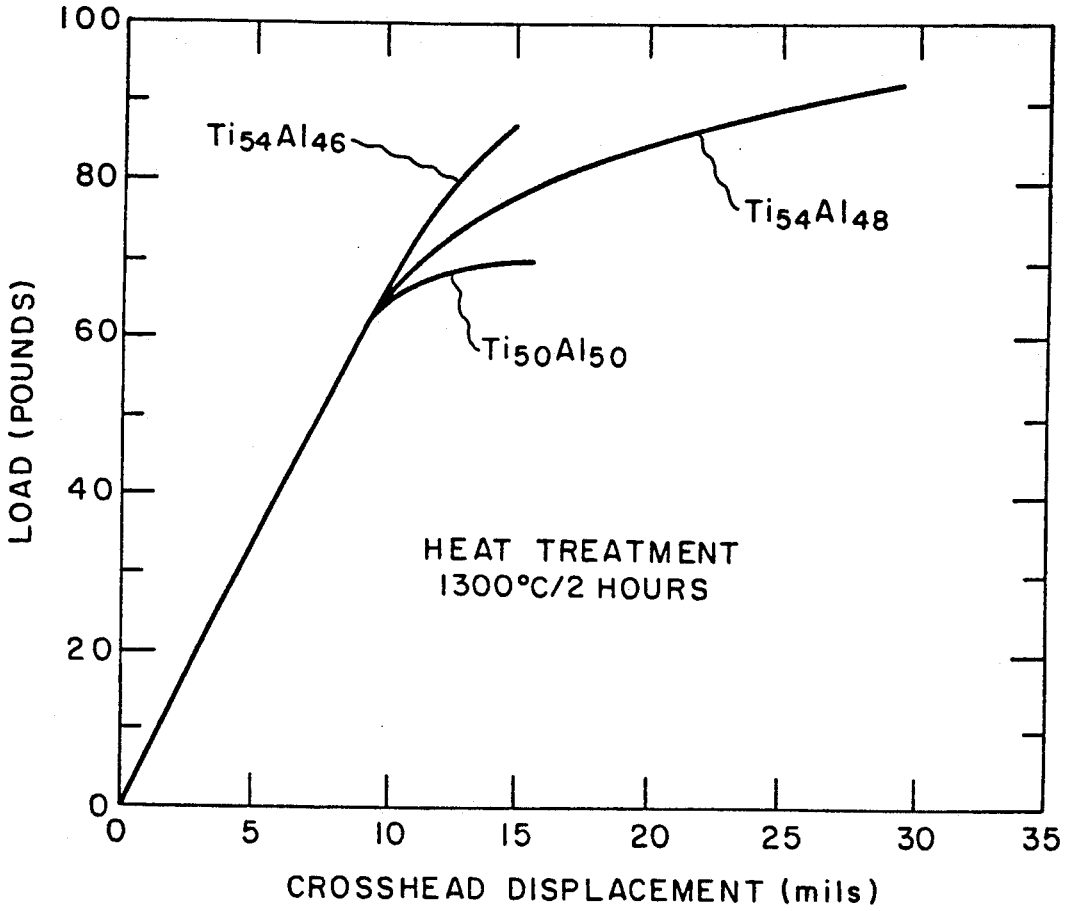
FIG. 4 is a graph illustrating the relationship between load in pounds and crosshead displacement in mils for TiAl compositions of different stoichiometry tested in 4-point bending.

The results are listed in the following Table I. Table I contains data on the properties of samples annealed at 1300° C. and further data on these samples in particular is given in FIG. 4.

TABLE I

| Ex. No. | Gamma Alloy No. | Composit. (at. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | * | 58 | 0 |
| 2 | 12 | $Ti_{52}Al_{48}$ | 1250 | 130 | 180 | 1.1 |
| | | | 1300 | 98 | 128 | 0.9 |

TABLE I-continued

| Ex. No. | Gamma Alloy No. | Composit. (at. %) | Anneal Temp (°C.) | Yield Strength (ksi) | Fracture Strength (ksi) | Outer Fiber Strain (%) |
|---|---|---|---|---|---|---|
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

* — No measurable value was found because the sample lacked sufficient ductility to obtain a measurement It is evident from the data of this table that alloy 12 for Example 2 exhibited the best combination of properties. This confirms that the properties of Ti-Al compositions are very sensitive to the Ti/Al atomic ratios and to the heat treatment applied. Alloy 12 was selected as the base alloy for further property improvements based on further experiments which were performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due, in turn, to an extensive beta transformation at temperatures appreciably above 1350° C.

Examples 4–13

Ten additional individual melts were prepared to contain titanium and aluminum in designated atomic ratios as well as additives in relatively small atomic percents.

Each of the samples was prepared as described above with reference to Examples 1–3.

The compositions, annealing temperatures, and test results of tests made on the compositions are set forth in Table II in comparison to alloy 12 as the base alloy for this

TABLE II

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | * | 131 | 0 |
| 5 | 24 | $Ti_{52}Al_{46}Ag_2$ | 1200 | * | 114 | 0 |
| | | | 1300 | 92 | 117 | 0.5 |
| 6 | 25 | $Ti_{50}Al_{48}Cu_2$ | 1250 | * | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.2 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | * | 89 | 0 |
| | | | 1300 | * | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | * | 143 | 0 |
| | | | 1250 | 135 | 154 | 0.3 |
| | | | 1300 | 131 | 149 | 0.2 |

TABLE II-continued

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 13 | 20 | $Ti_{49.5}Al_{49.5}Er_1$ | + | + | + | + |

* — See asterisk note to Table I

+ — Material fractured during machining to prepare test specimens

For Examples 4 and 5, heat treated at 1200° C., the yield strength was unmeasurable as the ductility was found to be essentiallv nil. For the specimen of Example 5 which was annealed at 1300° C., the ductility increased, but it was still undesirably low.

For Example 6, the same was true for the test specimen annealed at 1250° C. For the specimens of Example 6 which were annealed at 1300° and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 4, it is evident that the stoichiometric ratio or nonstoichiometric ratio has a strong influence on the test properties which formed for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent, then a composition $Ti_{48}Al_{48}X_4$ will give an effective aluminum concentration of 48 atomic percent and an effective titanium concentration of 52 atomic percent.

If, by contrast, the X additive acts as an aluminum substituent, then the resultant composition will have an effective aluminum concentration of 52 percent and an effective titanium concentration of 48 atomic percent.

Accordingly, the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition, there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a nonstoichiometric TiAl composition are highly unpredictable and that most test results are unsuccessful with respect to ductility or strength or to both.

EXAMPLES 14–17

A further parameter of the gamma titanium aluminide alloys which include additives is that combinations of additives do not necessarily result in additive combinations of the individual advantages resulting from the individual and separate inclusion of the same additives.

Four additional TiAl based samples were prepared as described above with reference to Examples 1–3 to contain individual additions of vanadium, niobium, and tantalum as listed in Table III. These compositions are the optimum compositions reported in copending applications Ser. Nos. 138,476, 138,408, and 138,485, respectively.

The fourth composition is a composition which combines the vanadium, niobium and tantalum into a single alloy designated in Table III to be alloy 48.

From Table III, it is evident that the individual additions vanadium, niobium and tantalum are able on an individual basis in Examples 14, 15, and 16 to each lend substantial improvement to the base TiAl alloy. However, these same additives when combined into a single combination alloy do not result in a combination of the individual improvements in an additive fashion. Quite the reverse is the case.

In the first place, the alloy 48 which was annealed at the 1350° C. temperature used in annealing the individual alloys was found to result in production of such a brittle material that it fractured during machining to prepare test specimens.

Secondly, the results which are obtained for the combined additive alloy annealed at 1250° C. are very inferior to those which are obtained for the separate alloys containing the individual additives.

In particular, with reference to the ductility, it is evident that the vanadium was very successful in substantially improving the ductility in the alloy 14 of Example 14. However, when the vanadium is combined with the other additives in alloy 48 of Example 17, the ductility improvement which might have been achieved is not achieved at all. In fact, the ductility of the base alloy is reduced to a value of 0.1.

Further, with reference to the oxidation resistance, the niobium additive of alloy 40 clearly shows a very substantial improvement in the 4 mg/cm2 weight loss of alloy 40 as compared to the 31 mg/cm2 weight loss of the base alloy. The test of oxidation, and the complementary test of oxidation resistance, involves heating a sample to be tested at a temperature of 982° C. for a period of 48 hours. After the sample has cooled, it is scraped to remove any oxide scale. By weighing the sample both before and after the heating and scraping, a weight difference can be determined. Weight loss is determined in mg/cm2 by dividing the total weight loss in grams by the surface area of the specimen in square centimeters. This oxidation test is the one used for all measurements of oxidation or oxidation resistance as set forth in this application.

For the alloy 60 with the tantalum additive, the weight loss for a sample annealed at 1325° C. was determined to be 2 mg/cm2 and this is again compared to the 31 mg/cm2 weight loss for the base alloy. In other words, on an individual additive basis both niobium and tantalum additives were very effective in improving oxidation resistance of the base alloy.

However, as is evident from Example 17, results listed in Table III alloy 48 which contained all three additives, vanadium, niobium and tantalum in combination, the oxidation is increased to about double that of the base alloy. This is seven times greater than alloy 40 which contained the niobium additive alone and about 15 times greater than alloy 60 which contained the tantalum additive alone.

In other words, it has been found that vanadium can individually contribute advantageous ductility improvements to gamma titanium aluminum compound and that tantalum can individually contribute to ductility and oxidation improvements. It has been found separately that niobium additives can contribute beneficially to the strength and oxidation resistance properties of titanium aluminum. However, the Applicant has found, as is indicated from this Example 17, that when vanadium, tantalum, and niobium are used together and are combined as additives in an alloy composition, the alloy composition is not benefited by the additions but rather there is a net decrease or loss in properties of the TiAl which contains the niobium, the tantalum, and the vanadium additives. This is evident from Table III.

From this, it is evident that, while it may seem that if two or more additive elements individually improve

TABLE III

| Ex. No. | Gamma Alloy No. | Composit. (at. %) | Anneal Temp (°C.) | Yield Strength (ksi) | Fracture Strength (ksi) | Outer Fiber Strain (%) | Weight Loss After 48 hours @ 98° C. (mg/cm$^2$) |
|---|---|---|---|---|---|---|---|
| 2 | 12 | $Ti_{52}Al_{48}$ | 1250 | 130 | 180 | 1.1 | * |
| | | | 1300 | 98 | 128 | 0.9 | * |
| | | | 1350 | 88 | 122 | 0.9 | 31 |
| 14 | 14 | $Ti_{49}Al_{48}V_3$ | 1300 | 94 | 145 | 1.6 | 27 |
| | | | 1350 | 84 | 136 | 1.5 | * |
| 15 | 40 | $Ti_{50}Al_{46}Nb_4$ | 1250 | 136 | 167 | 0.5 | * |
| | | | 1300 | 124 | 176 | 1.0 | 4 |
| | | | 1350 | 86 | 100 | 0.1 | * |
| 16 | 60 | $Ti_{48}Al_{48}Ta_4$ | 1250 | 120 | 147 | 1.1 | * |
| | | | 1300 | 106 | 141 | 1.3 | * |
| | | | 1325 | * | * | * | * |
| | | | 1325 | * | * | * | 2 |
| | | | 1350 | 97 | 137 | 1.5 | * |
| | | | 1400 | 72 | 92 | 0.2 | * |
| 17 | 48 | $Ti_{49}Al_{45}V_2Nb_2Ta_2$ | 1250 | 106 | 107 | 0.1 | 60 |
| | | | 1350 | + | + | + | * |

* — Not measured

+ — Material fractured during machining to prepare test specimen

The individual advantages or disadvantages which result from the use of individual additives repeat reliably as these additives are used individually over and over again. However, when additives are used in combination the effect of an additive in the combination in a base alloy can be quite different from the effect of the additive when used individually and separately in the same base alloy. Thus, it has been discovered that addition of vanadium is beneficial to the ductility of titanium aluminum compositions and this is disclosed and discussed in the copending application for patent Ser. No. 138,476. Further, one of the additives which has been found to be beneficial to the strength of the TiAl base and which is described in copending application Ser. No. 138,408, filed Dec. 28, 1987, as discussed above, is the additive niobium. In addition, it has been shown by the McAndrew paper discussed above that the individual addition of niobium additive to TiAl base alloy can improve oxidation resistance. Similarly, the individual addition of tantalum is taught by McAndrew as assisting in improving oxidation resistance. Furthermore, in copending application Ser. No. 138,485, it is disclosed that addition of tantalum results in improvements in ductility.

TiAl that their use together should render further improvements to the TiAl, it is found, nevertheless, that such additions are highly unpredictable and that, in fact, for the combined additions of vanadium, niobium and tantalum a net loss of properties result from the combined use of the combined additives together rather than resulting in some combined beneficial overall gain of properties.

However, from Table III above, it is evident that the alloy containing the combination of the vanadium, niobium and tantalum additions has far worse oxidation resistance than the base TiAl 12 alloy of Example 2. Here, again, the combined inclusion of additives which improve a property on a separate and individual basis have been found to result in a net loss in the very property which is improved when the additives are included on a separate and individual basis.

EXAMPLES 18 THRU 21

Four additional samples were prepared as described above with reference to Examples 1–3 to contain chromium modified titanium aluminide having compositions respectively as listed in Table IV.

Table IV summarizes the bend test results on all of the alloys, both standard and modified, under the various heat treatment conditions deemed relevant.

TABLE IV

| Ex. No. | Gamma Alloy No. | Composition (at. %) | Anneal Temp (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 18 | 37 | $Ti_{52}Al_{46}Mn_2$ | 1250 | 111 | 167 | 1.6 |
| | | | 1300 | 98 | 143 | 0.8 |
| | | | 1350 | 70 | 90 | 0.2 |
| 19 | 54 | $Ti_{50}Al_{48}Mn_2$ | 1250 | 106 | 125 | 0.5 |
| | | | 1300 | 95 | 111 | 0.3 |
| | | | 1350 | * | 63 | 0 |
| 20 | 50 | $Ti_{52}Al_{44}Mn_4$ | 1250 | 72 | 90 | 0.2 |
| 21 | 61 | $Ti_{48}Al_{48}Mn_4$ | 1250 | 109 | 136 | 0.6 |
| | | | 1300 | 97 | 132 | 0.8 |
| | | | 1350 | 92 | 120 | 0.7 |

* — No measurable value was found because the sample lacked sufficient ductility to obtain a measurement From the results listed in Table IV, it is evident that, based on the four-point bend testing the manganese additive has an influence on the strength and ductility properties of the resultant alloys. Alloy 37 shows a distinct improvement in ductility when annealed at 1250° C. without a loss of strength which compares in percentage to the 60% gain in ductility.

For the most part, the values of strength and ductility of the other alloys of the series of tests of Table IV are lower than those of the base $Ti_{52}Al_{48}$ alloy.

The above samples were prepared as described in Examples 1-3. Also, the above samples of Examples 1-21 were tested by the four-point bending test.

EXAMPLES 22-26

Five additional samples were prepared as described above with reference to Examples 1-3 to contain titanium aluminide having compositions respectively as listed in Tables V below.

The Table V summarizes the bend test results on most of the alloys both standard and modified under the various heat treatment conditions deemed relevant.

The strength data was obtained by four point bending tests and these data are plotted in Table V.

TABLE V

| Data Based On Four Point Bend Testing | | | | | | |
|---|---|---|---|---|---|---|
| Ex. No. | Gamma Alloy No. | Composition (at. %) | Anneal Temp (°C.) | Yield Strength (ksi) | Fracture Strength (ksi) | Outer Fiber Strain (%) |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 22 | 42 | $Ti_{52}Al_{46}Ta_2$ | 1250 | 131 | 163 | 0.6 |
| | | | 1300 | 112 | 146 | 0.4 |
| | | | 1350 | 83 | 90 | 0.1 |
| 23 | 68 | $Ti_{50}Al_{48}Ta_2$ | 1250 | 125 | 147 | 0.7 |
| | | | 1300 | 106 | 139 | 0.8 |
| | | | 1350 | 97 | 131 | 1.0 |
| 24 | 43 | $Ti_{50}Al_{46}Ta_4$ | 1250 | 123 | 138 | 0.1 |
| | | | 1300 | — | 86 | 0 |
| 25 | 60 | $Ti_{48}Al_{48}Ta_4$ | 1250 | 120 | 147 | 1.1 |
| | | | 1300 | 106 | 141 | 1.3 |
| | | | 1350 | 97 | 137 | 1.5 |
| | | | 1400 | 72 | 92 | 0.2 |
| 26 | 108 | $Ti_{46}Al_{48}Ta_6$ | 1250 | 136 | 158 | 0.4 |

The outer fiber strain or ductility was reduced relative to alloy 12 for alloys 42 and 43, while both properties were increased for alloy 60, particularly when annealed at higher temperatures.

For alloy 68 the yield strength is generally improved relative to base alloy 12 but the outer fiber strain remains about the same.

For alloy 108 the yield strength is also generally improved relative to base alloy 12 but the outer fiber strain is substantially reduced to less than half that of base alloy 12.

Alloy 60, when heat treated at 1300° C. to 1350° C. thus, has the optimum combination of room temperature properties.

As is pointed out in copending application Ser. No. 138,485, filed Dec. 28, 1987, this remarkable increase in ductility of alloy 60 was an unexpected result.

The increased ductility appears to be a result of the reduced Al/Ti ratio, the high tantalum modification, and the use of rapid solidification processing.

Like the base alloy, alloy 60 also undergoes a beta transition above 1350° C. The properties are precipitously reduced above that temperature.

Regarding now the Ogden reference listed above and entitled "Mechanical Properties of High Purity Ti-Al Alloys", this reference teaches a titanium alloy having 35 weight percent aluminum and 7 weight percent tantalum. As noted above, this is equivalent to a composition having the formula in atomic percentages of $Ti_{47.5}Al_{51}Ta_{1.5}$.

As also noted above, the author reported an ultimate tensile strength of 76,060 psi (76 ksi) and a ductility of about 1.5%. No yield strength of that alloy was reported in that paper.

As is evident from the data set forth in Table III above this ductility of 1.5% reported by Ogden is about equivalent to that of the alloy 60 which was annealed at 1350° C. However, the ultimate tensile strength of alloy 60 annealed at this temperature is about 137 ksi. In other words the fracture strength of alloy 60 is about 80% higher than the highest values reported by Ogden. Neither the unexpected benefits of the higher tantalum concentrations, nor the criticality of achieving a specific aluminum to titanium ratio were recognized by Ogden.

As has been pointed out above, it is the combination of strength and ductility which is most critical in judging the comparative advantages of an alloy. A gain of 80% in strength with no loss in ductility is a remarkable advance in the technology of TiAl alloys.

EXAMPLES 27-29

Three additional alloy samples were prepared by ingot metallurgy.

The preparation by ingot metallurgy is different from the preparation of the other alloy samples as described above.

As used herein, the term "ingot metallurgy" refers to a melting of the ingredients of the alloys 135, 182 and 183 in the proportions set forth in Table VI below and corresponding exactly to the proportions set forth for Examples 27, 28 and 29. The ingot metallurgy involves a melting of the ingredients and solidification of the ingredients into an ingot. By contrast, the rapid solidification method involves the formation of a ribbon by the melt spinning method followed by the consolidation of the ribbon into a fully dense coherent metal sample.

In the ingot melting procedure of Examples 27 through 29, the ingot is prepared to a dimension of about 2" in diameter and about ½" thick in the approximate shape of a hockey puck. Following the melting and solidification of the hockey puck-shaped ingot, the ingot is enclosed within a steel annulus having a wall thickness of about ½" and having a vertical thickness which matches identically that of the hockey puck-shaped ingot. Before being enclosed within the retaining ring, the hockey puck ingot is homogenized by being heated to 1250° C. for two hours. The assembly of the hockey puck and containing ring are heated to a temperature of about 975° C. The heated sample and containing ring are forged to a thickness of approximately half that of the original thickness.

Following the forging and cooling of the specimen, tensile specimens were prepared corresponding to conventional tensile specimens. These tensile specimens are subjected to the same conventional tensile testing as is conventionally employed and the yield strength, tensile strength and plastic elongation measurements resulting from these tests are listed in Table VI for Examples 27 through 29.

A composition having the same composition as that of Example 2 above was prepared by the ingot metallurgy method and this composition is included in Table VI as Example 2A.

As is evident from the Table VI results, the individual test samples were subjected to different annealing temperatures prior to performing the actual tensile tests. For Examples 27 through 29 of Table VI, the annealing temperature employed on the tensile test specimens are indicated in the Table. The samples were individually annealed at the different temperatures listed in Table VI and specifically 1275° C., 1300° C., 1325° C., and 1350° C. Following this annealing treatment for approximately two hours, the samples were subjected to conventional tensile testing and the results again are listed in Table VI for the separately treated tensile test specimens. Table VI also includes data on oxidation resistance of some samples.

TABLE VI

| Ex. No. | Alloy No. | Composition (at. %) | Anneal Temp. (°C.) | Yield Strength (ksi) | Fracture Strength (ksi) | Ductility (%) | Weight Loss After 48 hrs. @ 982° C. (mg/cm$^2$) |
|---|---|---|---|---|---|---|---|
| 2A | 12A | $Ti_{52}Al_{48}$ | 1300 | 54 | 73 | 2.6 | 53 |
| | | | 1325 | 50 | 71 | 2.3 | — |
| | | | 1350 | 53 | 72 | 1.6 | — |
| 27 | 135 | $Ti_{48}Al_{48}Mn_2Ta_2$ | 1275 | 59 | 74 | 1.9 | — |
| | | | 1300 | 60 | 76 | 2 | 6 |
| | | | 1325 | 59 | 77 | 2.1 | — |
| | | | 1350 | 63 | 74 | 1 | — |
| 28 | 182 | $Ti_{46}Al_{49}Mn_2Ta_3$ | 1300 | 52 | 62 | 1.4 | — |
| | | | 1325 | 54 | 68 | 2 | — |
| | | | 1350 | 55 | 66 | 1.5 | — |
| 29 | 183 | $Ti_{44}Al_{50}Mn_2Ta_4$ | 1300 | 53 | 62 | 1.2 | — |
| | | | 1325 | 56 | 67 | 1.6 | — |
| | | | 1350 | 57 | 70 | 1.7 | — |

This last series of tests demonstrates that the titanium-aluminum base alloys which have a combination of manganese and tantalum additives have a very desirable combination of strength and ductility properties. Effective ductility is retained over a range of concentrations of the tantalum additive.

A desirable set of properties are achieved for alloys prepared by conventional ingot technology.

Good oxidation resistance properties are displayed as well by these compositions. This data is plotted in FIG. 1 and shows the very substantial improvement which results from inclusion of the combination of manganese and tantalum. Regarding oxidation resistance testing, it is the practice in this art to conduct such testing in sets. That is, a group of samples are tested as a set using the same furnace and testing conditions. This testing in sets is done because there are variations in test results from day to day because of differences in humidity and other factors which affect the metal surfaces being tested. The values of oxidation resistance in any table are accurate and valid on a comparative basis. However, the values from one table may not be accurately comparable to the values from a different table where they are not tested as part of the same set.

What is claimed and sought to be protected by Letters Patent of the United States is as follows:

1. A tantalum and manganese modified titanium aluminum alloy consisting essentially of titanium, aluminum, tantalum and manganese in the following approximate atomic ratio:

$$Ti_{52-43}Al_{46-50}Ta_{1-4}Mn_{1-3}.$$

2. A tantalum and manganese modified titanium aluminum alloy consisting essentially of titanium, aluminum, tantalum and manganese in the approximate atomic ratio:

$$Ti_{51-45}Al_{46-50}Ta_2Mn_{1-3}.$$

3. A tantalum and manganese modified titanium aluminum alloy consisting essentially of titanium, aluminum, tantalum and manganese in the following approximate atomic ratio:

$$Ti_{51-44}Al_{46-50}Ta_{1-4}Mn_2.$$

4. A tantalum and manganese modified titanium aluminum alloy consisting essentially of titanium, aluminum, tantalum and manganese in the approximate atomic ratio:

$Ti_{50-46}Al_{46-50}Ta_2Mn_2$.

5. A tantalum and manganese modified titanium aluminum alloy consisting essentially of titanium, aluminum, tantalum and manganese in the following approximate atomic ratio:

$Ti_{49-47}Al_{47-49}Ta_2Mn_2$.

6. The method of improving the oxidation resistance of a structural member formed of TiAl which comprises adjusting the stoichiometric ratio of Ti to Al and incorporating manganese and tantalum in the member according to the following formula in atomic percent:

$Ti_{52-43}Al_{46-50}Ta_{1-4}Mn_{1-3}$.

7. A structural member, said member being formed of an alloy having the following composition in atomic percent:

$Ti_{52-43}Al_{46-50}Ta_{1-4}Mn_{1-3}$.

* * * * *